US008394260B2

(12) United States Patent
Choi

(10) Patent No.: US 8,394,260 B2
(45) Date of Patent: Mar. 12, 2013

(54) PETROLEUM UPGRADING PROCESS

(75) Inventor: Ki-Hyouk Choi, Dhahran (SA)

(73) Assignee: Saudi Arabian Oil Company (SA)

( * ) Notice: Subject to any disclaimer, the term of this patent is extended or adjusted under 35 U.S.C. 154(b) by 673 days.

(21) Appl. No.: 12/643,743

(22) Filed: Dec. 21, 2009

(65) Prior Publication Data

US 2011/0147266 A1 Jun. 23, 2011

(51) Int. Cl.
*C10G 9/00* (2006.01)

(52) U.S. Cl. ..... 208/106

(58) Field of Classification Search ..... 208/106
See application file for complete search history.

(56) References Cited

U.S. PATENT DOCUMENTS

| | | | |
|---|---|---|---|
| 2,623,596 | A | 12/1952 | Whorton et al. |
| 3,948,754 | A | 4/1976 | McCollum et al. |
| 3,948,755 | A | 4/1976 | McCollum et al. |
| 3,983,027 | A | 9/1976 | McCollum et al. |
| 3,989,618 | A | 11/1976 | McCollum et al. |
| 4,005,005 | A | 1/1977 | McCollum et al. |
| 4,118,797 | A | 10/1978 | Tarpley, Jr. |
| 4,243,514 | A | 1/1981 | Bartholic |
| 4,443,325 | A | 4/1984 | Chen et al. |
| 4,446,012 | A | 5/1984 | Murthy et al. |
| 4,448,251 | A | 5/1984 | Stine |
| 4,483,761 | A | 11/1984 | Paspek, Jr. |
| 4,529,037 | A | 7/1985 | Froning et al. |
| 4,543,177 | A | 9/1985 | Murthy et al. |
| 4,543,190 | A | 9/1985 | Modell |
| 4,550,198 | A | 10/1985 | Myerson |
| 4,684,372 | A | 8/1987 | Hayes et al. |
| 4,733,724 | A | 3/1988 | Cardenas |
| 4,753,666 | A | 6/1988 | Pastor et al. |
| 4,813,370 | A | 3/1989 | Capamaggio |
| 4,818,370 | A | 4/1989 | Gregoli et al. |
| 4,840,725 | A | 6/1989 | Paspek |
| 4,951,561 | A | 8/1990 | Moorman et al. |
| 5,096,567 | A | 3/1992 | Paspek, Jr. et al. |
| 5,110,443 | A | 5/1992 | Gregoli et al. |
| 5,316,659 | A | 5/1994 | Brons et al. |
| 5,466,365 | A | 11/1995 | Savastano et al. |
| 5,496,464 | A | 3/1996 | Piskorz et al. |
| 5,674,405 | A | 10/1997 | Bourhis et al. |
| 5,725,054 | A | 3/1998 | Shayegi et al. |
| 5,778,977 | A | 7/1998 | Bowzer et al. |
| 5,851,381 | A | 12/1998 | Tanaka et al. |
| 5,885,440 | A | 3/1999 | Hoehn et al. |
| 5,914,031 | A | 6/1999 | Sentagnes et al. |
| 6,280,408 | B1 | 8/2001 | Sipin |
| 6,325,921 | B1 | 12/2001 | Andersen |
| 6,328,104 | B1 | 12/2001 | Graue |
| 6,475,396 | B1 | 11/2002 | Wofford, III et al. |
| 6,489,263 | B2 | 12/2002 | Murray et al. |
| 6,709,601 | B2 | 3/2004 | Wofford, III et al. |
| 6,764,213 | B2 | 7/2004 | Shechter |
| 6,878,290 | B2 | 4/2005 | Joussot-Dubien et al. |
| 7,144,498 | B2 | 12/2006 | McCall et al. |
| 7,740,065 | B2 | 6/2010 | Choi |
| 8,025,790 | B2 | 9/2011 | Choi et al. |
| 2002/0046838 | A1 | 4/2002 | Karanikas et al. |
| 2003/0168381 | A1 | 9/2003 | Hokari et al. |
| 2005/0167333 | A1 | 8/2005 | McCall et al. |
| 2006/0011511 | A1 | 1/2006 | Hokari et al. |
| 2006/0042999 | A1 | 3/2006 | Iqbal et al. |
| 2006/0157339 | A1 | 7/2006 | Cullen |
| 2006/0231455 | A1 | 10/2006 | Olsvik et al. |
| 2007/0045881 | A1 | 3/2007 | Aguirre |
| 2007/0056881 | A1 | 3/2007 | Berkowitz et al. |
| 2007/0090021 | A1 | 4/2007 | McCall et al. |
| 2007/0140935 | A1 | 6/2007 | Hazlebeck |
| 2007/0289898 | A1 | 12/2007 | Banerjee |
| 2008/0073292 | A1 | 3/2008 | Stenmark et al. |
| 2008/0099373 | A1 | 5/2008 | Hokari et al. |
| 2008/0099374 | A1 | 5/2008 | He et al. |
| 2008/0099376 | A1 | 5/2008 | He et al. |
| 2008/0099377 | A1 | 5/2008 | He et al. |
| 2008/0099378 | A1 | 5/2008 | He et al. |
| 2008/0121565 | A1 | 5/2008 | Yoo et al. |
| 2008/0149533 | A1 | 6/2008 | Yoo et al. |
| 2008/0264873 | A1 | 10/2008 | Gidner |
| 2009/0145805 | A1 | 6/2009 | Choi |
| 2009/0178952 | A1 | 7/2009 | Choi et al. |

FOREIGN PATENT DOCUMENTS

| | | |
|---|---|---|
| EP | 199555 | 10/1986 |
| EP | 423960 | 4/1991 |
| EP | 1342771 | 9/2003 |
| EP | 1505141 | 2/2005 |
| EP | 1537912 | 6/2005 |
| EP | 1616931 | 1/2006 |
| EP | 1826527 | 8/2007 |
| JP | 2000-104311 | 9/1998 |
| JP | 2000-109850 | 10/1998 |
| JP | 2000282063 | 10/2000 |

(Continued)

OTHER PUBLICATIONS

Sato, Takafumi et al., "Upgrading of asphalt with and without partial oxidation in supercritical water", Fuel 82 (2003) pp. 1231-1239, Elsevier.

(Continued)

*Primary Examiner* — Randy Boyer
(74) *Attorney, Agent, or Firm* — Bracewell & Giuliani LLP

(57) ABSTRACT

A process for upgrading a heavy oil stream by completely mixing the heavy oil stream with a water stream prior to the introduction of an oxidant stream. A mixture of the heavy oil stream and the water stream are subjected to operating conditions, in the presence of the oxidant stream, that are at or exceed the supercritical temperature and pressure of water. The resulting product stream is a higher value oil having low sulfur, low nitrogen, and low metallic impurities as compared to the heavy oil stream.

17 Claims, 1 Drawing Sheet

FOREIGN PATENT DOCUMENTS

| | | |
|---|---|---|
| JP | 2001192676 | 7/2001 |
| JP | 2003-049180 | 2/2003 |
| JP | 2003277770 | 10/2003 |
| JP | 2006-104311 | 4/2006 |
| WO | WO 2005-007776 | 1/2005 |
| WO | WO2008085436 | 7/2008 |

OTHER PUBLICATIONS

Adschiri, Tadafumi et al., "Hydrogenation through Partial Oxidation of Hydrocarbons in Supercritical Water", Int. J. of The Soc. of Mat. Eng. for Resources, vol. 7, No. 2 (1999) pp. 273-281.

Adschiri, Tadafumi et al., "Catalytic Hydrosesulfurization of Dibenzothiophene through Partial Oxidation and a Water-Gas Shift Reaction in Supercritical Water", Ind. Eng. Chem. Res., vol. 37 (1998) pp. 2634-2638.

Seid Mahdi Jafari et al., "Production of sub-micron emulsions by ultrasound and microfluidization techniques," Journal of Food Engineering, vol. 82, Science Direct, 2007, pp. 478-488, Elsevier Ltd.

Jiunn-Ren Lin et al., "An Upgrading Process Through Cavitation and Surfactant," Energy & Fuels 1993, vol. 7, pp. 111-118, American Chemical Society.

B. Abismail et al., "Emulsification by ultrasound: drop size distribution and stability," Ultrasonics Sonochemistry, vol. 6, 1999, pp. 75-83, Elsevier Science B.V.

T.S.H. Leong et al., "Minimising oil droplet size using ultrasonic emulsification," Ultrasonics Sonochemistry vol. 16, 2009, pp. 721-727, Elsevier B.V.

S. Kentish et al., "The use of ultrasonics for nanoemulsion preparation," Innovative Food Science and Emerging Technologies, vol. 9, 2008, pp. 170-175, Elsevier Ltd.

Zhao et al., "Experimental Study on Vacuum Residuum Upgrading through Pyrolysis in Supercritical Water," published on Energy & Fuels, vol. 20, pp. 2067-2071.

M.A. Mchugh & V.J. Krukonis. "Supercritical Fluid Extraction," 2nd ed., Butterworth-Heinemann, (1994), pp. 339-416.

Ancheyta, Jorge, Petroleum Refining: Modeling and Simulation of Catalytic Reactors for Petroleum Refining, First Edition; 2011; pp. 1-52; John Wiley & Sons, Inc.

Choi et al., "Petroleum Upgrading Process," U.S. Appl. No. 12/881,807, filed Sep. 14, 2010.

International Search Report and Written Opinion issued in PCT/US2011/051183 dated Nov. 23, 2011, 10 pgs.

R.J. Parker et al., "Liquefaction of Black Thunder Coal with Counterflow Reactor Technology," Ninth Pittsburgh Coal Conference Oct. 1992, Oct. 31, 1992, pp. 1191-1195.

Department of Trade of Industry of the United Kingdom, "Technology Status Report—Coal Liquefaction," Cleaner Coal Technology Programme, Oct. 31, 1999, pp. 1-14.

Amestica, L.A. and Wolf, E.E., Catalytic Liquefaction of Coal with Supercritical Water/CO/Solvent Media, XP-OO2663069, Fuel, Sep. 30, 1986, pp. 1226-1332, vol. 65, Butterworth & Co. (1986).

Robinson, P.R. and Kraus, L.S., Thermocheminstry of Coking in Hydroprocessing Units: Modeling Competitive Naphthalene Saturation and Condensation Reactions, XP-002663070, Apr. 26, 2006, Retrieved from Interent (see attached PCT Int'l Search Report dated Nov. 21, 2011).

PCT International Search Report dated Nov. 21, 2011 for International Application No. PCT/US2011/051192, International Filing Date Sep. 12, 2011.

PCT International Search Report, dated Jan. 3, 2011, International Application No. PCT/US2010/060728.

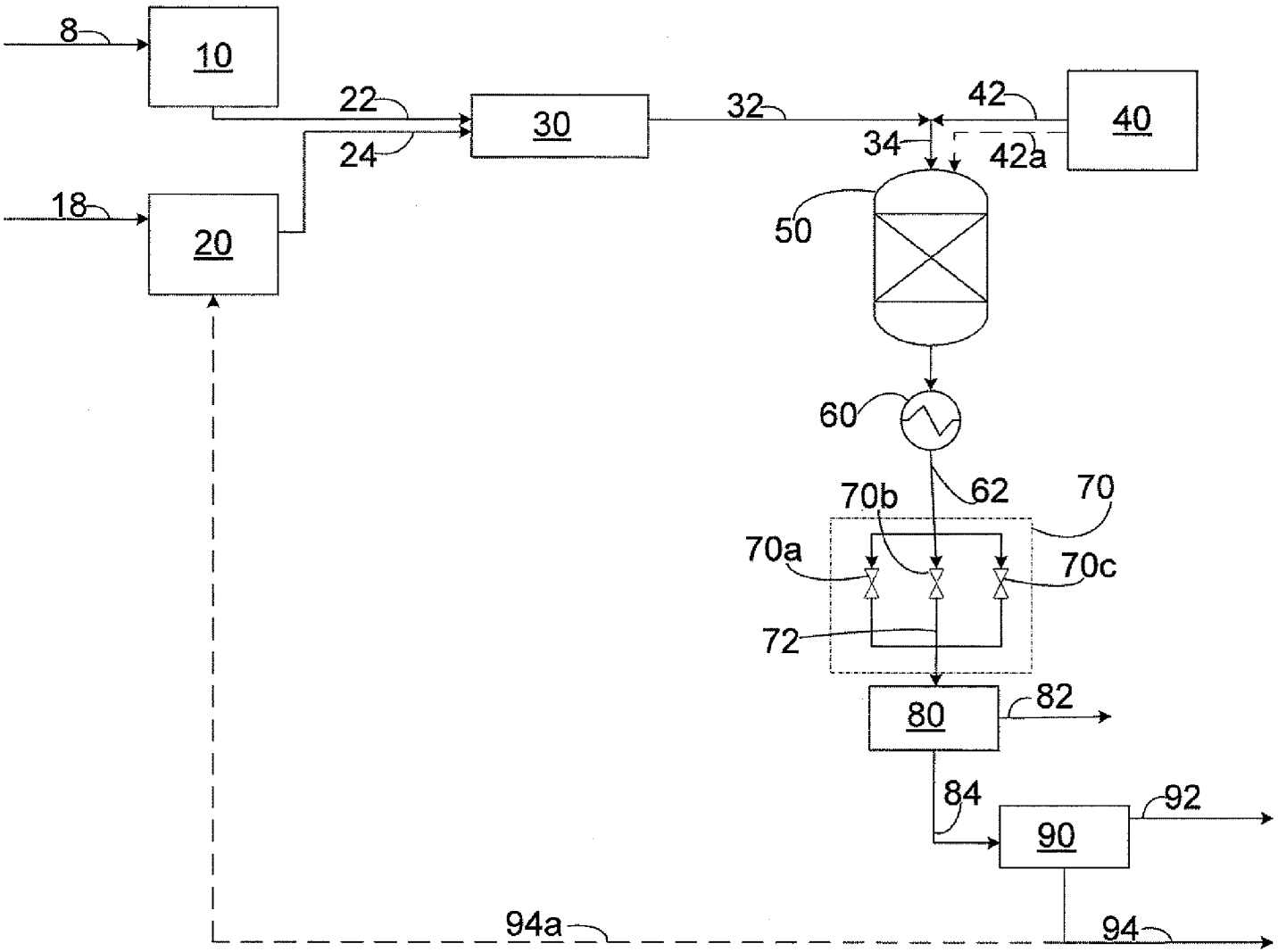
10
8
20
18
22
24
30
32
34
40
42
42a
50
60
62
70
70a
70b
70c
72
80
82
84
90
92
94
94a

PETROLEUM UPGRADING PROCESS

TECHNICAL FIELD OF THE INVENTION

The present invention relates to a process for upgrading heavy oil by contacting a heavy oil stream with supercritical water fluid and an oxidant stream. In particular, the hydrothermal upgrading process is conducted by completely mixing the water fluid and heavy oil prior to introducing the oxidant stream. Furthermore, the process is conducted without the use of an external supply of hydrogen or an external supply of catalyst to produce high value crude oil having low sulfur, low nitrogen, low metallic impurities, and an increased API gravity for use as a hydrocarbon feedstock.

BACKGROUND OF THE INVENTION

World-wide demand for petroleum products has increased dramatically in recent years, depleting much of the known, high value, light crude oil reservoirs. Consequently, production companies have turned their interest towards using low value, heavy oil in order to meet the ever increasing demands of the future. However, because current refining methods using heavy oil are less efficient than those using light crude oils, refineries producing petroleum products from heavier crude oils must refine larger volumes of heavier crude oil in order to get the same volume of final product. Unfortunately though, this does not account for the expected increase in future demand. Further exacerbating the problem, many countries have implemented or plan to implement more strict regulations on the specifications of the petroleum-based transportation fuel. Consequently, the petroleum industry is seeking to find new methods for treating heavy oil prior to refining in an effort to meet the ever-increasing demand for petroleum feedstocks and to improve the quality of available oil used in refinery processes.

In general, heavy oil provides lower amounts of the more valuable light and middle distillates. Additionally, heavy oil generally contains increased amounts of impurities, such as sulfur, nitrogen and metals, all of which require increased amounts of hydrogen and energy for hydroprocessing in order to meet strict regulations on impurity content in the final product.

Heavy oil, which is generally defined as bottom fraction from atmospheric and vacuum distillatory, also contains a high asphaltene content, low middle distillate yield, high sulfur content, high nitrogen content, and high metal content. These properties make it difficult to refine heavy oil by conventional refining processes to produce end petroleum products with specifications that meet strict government regulations.

Low-value, heavy oil can be transformed into high-value, light oil by cracking the heavy fraction using various methods known in the art. Conventionally, cracking and cleaning have been conducted using a catalyst at elevated temperatures in the presence of hydrogen. However, this type of hydroprocessing has a definite limitation in processing heavy and sour oil.

Additionally, distillation and/or hydroprocessing of heavy crude feedstock produce large amounts of asphaltene and heavy hydrocarbons, which must be further cracked and hydrotreated to be utilized. Conventional hydrocracking and hydrotreating processes for asphaltenic and heavy fractions also require high capital investments and substantial processing.

Many petroleum refineries perform conventional hydroprocessing after distilling oil into various fractions, with each fraction being hydroprocessed separately. Therefore, refineries must utilize the complex unit operations for each fraction. Further, significant amounts of hydrogen and expensive catalysts are utilized in conventional hydrocracking and hydrotreating processes. The processes are carried out under severe reaction conditions to increase the yield from the heavy oil towards more valuable middle distillates and to remove impurities such as sulfur, nitrogen, and metals.

Currently, large amounts of hydrogen are used to adjust the properties of fractions produced from conventional refining processes in order to meet required low molecular weight specifications for the end products; to remove impurities such as sulfur, nitrogen, and metal; and to increase the hydrogen-to-carbon ratio of the matrix. Hydrocracking and hydrotreating of asphaltenic and heavy fractions are examples of processes requiring large amounts of hydrogen, both of which result in the catalyst having a reduced life cycle.

Supercritical water has been utilized as a reaction medium for cracking hydrocarbons with or without the addition of an external source of hydrogen. Water has a critical point at about 705° F. (374° C.) and about 22.1 MPa. Above these conditions, the phase boundary between liquid and gas for water disappears, with the resulting supercritical water exhibiting high solubility toward organic compounds and high miscibility with gases.

Hot pressurized water provides a reaction medium for the heavy components to be cracked into low molecular weight hydrocarbons through facilitating mass diffusion, heat transfer, intra- or inter-molecular hydrogen transfer, stabilizing radical compounds for suppressing coke formation, and removing impurities such as sulfur, nitrogen and metal containing molecules. While the exact mechanism of the impurity removal has not been identified, the impurities seem to be concentrated in the coke or heavy fraction of the upgraded products. Through the use of supercritical water, these impurities can be further modified to avoid deleterious effects. The basic principles of supercritical fluid extraction are outlined in the Kirk Othmer Encyclopedia of Chemical Technology, 3rd Edition, John Wiley & Sons, Supplemental Volume, pp. 872-893 (1984).

However, utilizing supercritical water to upgrade heavy oil can have serious drawbacks. For example, hydrothermal processes, particularly those employing supercritical water, require large amounts of energy to heat and maintain the fluid (water and hydrocarbon) above the critical temperature.

Another shortcoming in using conventional hydrothermal processes can be coke formation. Heavy hydrocarbon molecules dissolute into supercritical water more slowly than their lighter counterparts. Furthermore, asphaltenic molecules, which have a tangled structure, do not untangle easily with supercritical water. Consequently, the portions of the heavy hydrocarbon molecules that do not make contact with the supercritical water decompose by themselves, resulting in large amounts of coke. Therefore, reacting heavy oil with supercritical water using current methods leads to accumulation of coke inside the reactor.

When coke accumulates inside a reactor, the coke acts as an insulator and effectively blocks the heat from radiating throughout the reactor, leading to increased energy costs, since the operator must increase the operating temperature to offset for the build-up. Furthermore, accumulated coke can also increase the pressure drop throughout the process line, causing additional increases in energy costs.

One of the causes of coke formation using supercritical water is attributable to limited availability of hydrogen. Several proposals have been suggested to supply external hydrogen to a feed hydrocarbon treated with supercritical water fluid. For example, hydrogen gas can be added directly to the feed stream. Carbon monoxide can also be added directly to the feed stream to generate hydrogen through a water-gas-shift (WGS) reaction between carbon monoxide and water. Organic substances such as formic acid can also be added to the feed stream to generate hydrogen through a WGS reaction with carbon monoxide, which is produced from decomposition of added organic substances and water.

One other possible solution to prevent coke build-up is to increase the residence time of the heavy oil within the reactor to dissolve all hydrocarbons into supercritical water; however, the overall economy of the process would be reduced. Additionally, improvements in reactor design could be helpful; however, this would require large expenditures in design costs and might ultimately not prove beneficial. Therefore, there is a need for a process to facilitate the efficient contacting of heavy oil with supercritical water, which does not result in large amounts of coke or substantial increases in operating costs.

Furthermore, it would be desirable to have an improved process for upgrading heavy oil with supercritical water fluid that requires neither an external supply of hydrogen nor the presence of an externally supplied catalyst. It would be advantageous to create a process and apparatus that allows for the upgrade of the heavy oil, rather than the individual fractions, to reach the desired qualities such that the refining process and various supporting facilities can be simplified.

Additionally, it would be beneficial to have an improved process that did not require complex equipment or facilities associated with other processes that require hydrogen supply or coke removal systems so that the process may be implemented at the production site.

SUMMARY OF THE INVENTION

The present invention is directed to a process that satisfies at least one of these needs. The present invention includes a process for upgrading heavy oil in the absence of externally supplied hydrogen or externally supplied catalyst. The process generally includes combining a heated heavy oil stream with a heated water feed stream in a mixing zone to form a heavy oil/water mixture and allowing the heavy oil/water mixture to become well mixed. A heated oxidant stream is then added to the heavy oil/water mixture to form a reaction mixture. The reaction mixture is introduced into a reaction zone where the reaction mixture is subjected to operating conditions that are at or exceed the supercritical conditions of water to form an upgraded mixture. In another embodiment of the present invention, the heated oxidant stream can be introduced into the reaction zone as a separate stream from the heavy oil/water mixture.

In one embodiment, the reaction mixture has a residence time within the reaction zone in the range of about 1 second to 120 minutes. In another embodiment, the reaction mixture has a residence time within the reaction zone in the range of about 1 minute to 60 minutes. In yet another embodiment, the reaction mixture has a residence time within the reaction zone in the range of about 2 minute to 30 minutes. During this time, the reaction mixture is subjected to operating conditions that are at or exceed the supercritical conditions of water, such that at least a portion of hydrocarbons in the reaction mixture undergo cracking to form the upgraded mixture. Preferably, the reaction zone is essentially free of an externally-provided catalyst and essentially free of an externally-provided hydrogen source. Upon upgrading, the upgraded mixture exits the reaction zone and is subsequently cooled and depressurized to form a cooled upgraded-mixture. The cooled upgraded-mixture is separated by a gas-liquid separator into a gas stream and a liquid stream. The liquid stream is further separated by an oil-water separator into a recovered water stream and an upgraded oil stream, wherein the upgraded oil stream has reduced amounts of asphaltene, sulfur, nitrogen or metal containing substances, as well as an increased API gravity as compared to the heavy oil.

In an additional embodiment of the present invention, the mixing zone can include an ultrasonic wave generator that is operable to emit a frequency. Preferably, the frequency can be between about 10 to about 50 kHz, more preferably about 20 to about 40 kHz. In one embodiment, the heavy oil/water mixture has a residence time within the mixing zone in the range of about 10 to about 120 minutes.

In an additional embodiment of the present invention, the heated heavy oil stream has an oil temperature, wherein the oil temperature is in the range of about 10° C. to about 250° C. at a pressure at or exceeding critical pressure of water. In an embodiment of the present invention, the heated water stream has a water temperature, wherein the water temperature is in the range of about 250° C. to about 650° C. at a pressure at or exceeding the critical pressure of water. In an embodiment of the present invention, the heated oxidant stream has an oxidant temperature, wherein the oxidant temperature is in the range of about 250° C. to about 650° C. at a pressure at or exceeding the critical pressure of water.

In an embodiment of the present invention, the oxidant stream includes an oxygen-containing species and water. The oxygen-containing species can be selected from the group consisting of oxygen gas, air, hydrogen peroxide, organic peroxide, inorganic peroxide, inorganic superoxide, sulfuric acid, nitric acid, and combinations thereof. In one embodiment, the oxidant stream has an oxygen-containing species concentration of about 0.1 weight percent to about 75 weight percent. Preferably the oxygen-containing species concentration is about 1 weight percent to 50 weight percent, and more preferably about 5 weight percent to about 25 weight percent.

In an embodiment of the present invention, the reactant mixture preferably has a residence time within the reaction zone of 1 second to 120 minutes, more preferably 1 minute to 60 minutes, and most preferably 2 minutes to 30 minutes.

In another embodiment of the present invention, the process includes combining the heated heavy oil stream with the heated water feed stream in the mixing zone to form the heavy oil/water mixture and allowing the heavy oil/water mixture to become well mixed, and introducing the heavy oil/water mixture in the presence of the oxidant stream into the reaction zone. The heavy oil/water mixture and the oxidant stream are subjected to operating conditions that are at or exceed the supercritical conditions of water, such that at least a portion of hydrocarbons in the heavy oil/water mixture undergo cracking to form the upgraded mixture, wherein the reaction zone being essentially free of externally-provided catalyst and essentially free of externally-provided hydrogen source. The upgraded mixture is removed from the reaction zone and cooled and depressurized to form the cooled upgraded-mixture prior to separating the cooled upgraded-mixture into a gas stream and a liquid stream. The liquid stream is separated into the upgraded oil stream and the recovered water, wherein the upgraded oil stream comprises upgraded heavy oil having reduced amounts of asphaltene, sulfur, nitrogen or metal containing substances and an increased API gravity as compared to the heated heavy oil stream. In a further embodiment, the recovered water stream is oxidized under supercritical conditions to form a treated water stream, wherein the treated water stream is then recycled back into the process by combining the treated water stream with the heated water feed stream.

In another embodiment, the process includes heating a pressurized oxidant stream to a temperature that is between 250° C. and 650° C., wherein the pressurized oxidant stream is at a pressure exceeding the critical pressure of water. The heated heavy oil stream is mixed with the heated water feed to form a heated oil/water stream, wherein the heated heavy oil stream is comprised of hydrocarbon molecules, wherein the heated water feed stream is comprised of supercritical water fluid, wherein the supercritical water fluid is in an amount sufficient to completely surround substantially all of the individual hydrocarbon molecules thereby producing a cage effect around substantially all of the hydrocarbon molecules. The pressurized oxidant stream is combined with the heavy oil/water stream in the reaction zone under reaction zone conditions, wherein the reaction zone conditions are at or exceed the supercritical temperature and pressure of water, such that a substantial portion of the hydrocarbon molecules are upgraded thereby forming an upgraded mixture. The upgraded mixture is then cooled, depressurized and separated into a gas phase, an oil phase and a recovered water phase, wherein the oil phase has reduced amounts of asphaltene, sulfur, nitrogen or metal containing substances and an increased API gravity as compared to the heated heavy oil stream, as well as reduced amounts of coke formation as compared to a process having an absence of cage effect around substantially all of the hydrocarbon molecules.

In another embodiment, the invention also provides for an apparatus for upgrading heavy oil in an environment free of an externally supplied catalyst or externally supplied hydrogen source. The apparatus can include a heavy oil introduction line, a water feed introduction line, an oxidant introduction line, the mixing zone, the reaction zone, a cooling zone, a pressure regulating zone, a liquid-gas separator, and a water-oil separator. The mixing zone is fluidly connected to the heavy oil introduction line and is operable to receive the heavy oil from the heavy oil introduction line. The mixing zone is also fluidly connected to the water feed introduction line and is operable to receive water from the water feed introduction line such that the mixing zone is operable to combine the heavy oil with the water at an elevated temperature to create a heavy oil/water mixture. The reaction zone is fluidly connected with the mixing zone and the oxidant introduction line and is operable to receive the heavy oil/water mixture and the oxidant stream. The main reactor is operable to withstand a temperature that is at least as high as the critical temperature of water as well as being operable to withstand pressure in excess of the critical pressure of water. Furthermore, the reaction zone is essentially free of an externally-provided catalyst and essentially free of an externally-provided hydrogen source. The reaction zone can include a main reactor having an interior portion. The cooling zone is operable to reduce the temperature of the upgraded mixture leaving the reaction zone, and the pressure regulating zone is operable to reduce the pressure of the upgraded mixture leaving the cooling zone. The liquid-gas separator is fluidly connected to the pressure regulating zone and is operable to separate liquid and gases to create the liquid stream and the gas stream. The water-oil separator is fluidly connected to the liquid-gas separator and is operable to separate the liquid stream into the recovered water stream and the upgraded hydrocarbon stream.

In an additional embodiment of the present invention, the apparatus can also include an oxidation reactor that is fluidly connected with the water-oil separator via the recovered water stream. The oxidation reactor is operable to clean the recovered water stream before the recovered water stream is recycled and combined with the heated water feed stream.

In a further embodiment of the present invention, the mixing zone comprises a T-fitting. In another embodiment, the mixing zone comprises an ultrasonic wave generator, which is preferably a stick-type ultrasonic wave generator, a coin-type ultrasonic wave generator, or combinations thereof. In embodiments that implement ultrasonic waves to induce mixing, the sonic waves break the moiety of heavy hydrocarbon molecules and improve overall mixing with the heated water feed stream, forming an emulsion-like phase referred to herein as a submicromulsion. This submicromulsion contains oil droplets that generally have a mean diameter of less than 1 micron, and the submicromulsion can be created without an externally provided chemical emulsifier.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

FIG. 1 is an embodiment of the present invention.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

The present invention provides a process for converting heavy oil into more valuable crude oil feedstock without an external supply of hydrogen or an external supply of catalyst. In an embodiment of the present invention, the process of the present invention includes the steps of integrally mixing the heated heavy oil stream and the heated water feed stream to produce the heavy oil/water mixture, and thereafter exposing the heavy oil/water mixture to the reaction zone stage in the presence of the oxidant stream to form the upgraded mixture. The upgraded mixture is then exposed to cooling, depressurization and separation stages in order to collect the final product, which is the upgraded oil stream. Preferably, the thermal energy contained in the upgraded mixture from the reaction zone can be utilized to heat any of the feed streams by using suitable economizing equipment. Organic compounds included in the recovered water from the separating stage can be fully oxidized with hot pressurized water in the presence of an oxygen containing species to obtain clean water for recycling. The thermal energy that is contained in the product stream from the oxidation reaction can also be used for heat exchange purposes upstream.

Hot pressurized water provides a reaction medium for the heavy components to be cracked into low pour point and low molecular weight hydrocarbons through facilitating mass diffusion, heat transfer, intra- or inter-molecular hydrogen transfer, stabilizing radical compounds for suppressing coke formation and removing impurities such as sulfur, nitrogen and metal containing molecules. While the exact mechanism of the impurity removal has not been identified, the impurities seem to be concentrated in the coke, water or heavy fraction of the upgraded products. Through the use of supercritical water, these impurities can be oxidized or otherwise modified to avoid deleterious effects.

In embodiments utilizing ultrasonic waves, the ultrasonic waves reverberate throughout the heavy oil/water mixture causing the oil droplets to, in essence, break apart, resulting in the submicromulsion of water and oil micro-droplets, whereby the oil micro-droplets generally have mean diameters less than 1 micron. This submicromulsion reacts advantageously under supercritical conditions because the submicromulsion allows for improved contact between the heavy molecules and supercritical water, thereby reducing the overall production of low value coke. Additionally, some of the energy given off by the ultrasonic waves is transformed into heat energy, which in turn causes the submicromulsion's temperature to increase, which in turn advantageously requires less energy to heat the heavy oil/water mixture past the critical temperature of water. While using ultrasonic waves in the mixing zone is an example of a preferred embodiment, the present invention is not intended to be so limited.

FIG. 1 shows one of the embodiments of the present invention. Heavy oil is fed into heavy vessel 10 via line 8, where the heavy oil is subjected to increased pressures and temperatures. The temperature within heavy oil vessel 10 is preferably 10° C. to about 250° C., more preferably about 50° C. to about 200° C., and most preferably about 100° C. to about 175° C., with the pressure at or exceeding the critical pressure of water. Likewise, water is fed into water vessel 20 via line 18, and is subjected to increased pressures and temperatures. The temperature within water vessel 20 is preferably between 250° C. and 650° C., more preferably about 300° C. to about 550° C., and most preferably about 400° C. to about 550° C. with the pressure being at or exceeding the critical pressure of water. The heated heavy oil stream travels through heavy oil introduction line 22 en route to mixing zone 30. Likewise, the heated water feed stream travels through water feed introduction line 24 en route to mixing zone 30, where the heated water feed stream is combined with the heated heavy oil stream. These two streams are integrally mixed within mixing zone 30 and exit as heavy oil/water mixture 32. In one embodiment, the volumetric flow rate of the heated heavy oil stream to the heated water feed is about 1 to 10. In another embodiment, the volumetric flow rate of the heated heavy oil stream to the heated water feed is about 1 to 5. In yet another embodiment, the volumetric flow rate of the heated heavy oil stream to the heated water feed is about 1 to 2.

In one embodiment, mixing zone 30 can include an ultrasonic wave generator (not shown); however, mixing zone 30 can also be a simple T-fitting or any type of mechanical mixing device that is capable of improving mixing of the heavy oil/water mixture 32. In a preferred embodiment, the flow rate of heavy oil/water mixture 32 will be high enough such that heavy oil/water mixture 32 will experience turbulent flow, thereby further enhancing mixing of the oil and water within heavy oil/water mixture 32.

The temperature within oxidant vessel 40 is preferably between 250° C. and 650° C., more preferably about 300° C. to about 550° C., and most preferably about 400° C. to about 550° C., with the pressure being at or exceeding the critical pressure of water. The heated oxidant stream includes an oxygen-containing species and water. In one embodiment, the concentration of the oxygen-containing species is about 0.1 weight percent to about 75 weight percent. In another embodiment, the concentration of the oxygen-containing species is about 1 weight percent to about 50 weight percent. In yet another embodiment, the concentration of the oxygen-containing species is about 5 weight percent to about 10 weight percent.

The heated oxidant stream travels through oxidant introduction line 42, where the heated oxidant stream is either combined with heavy oil/water mixture 32 to form reaction mixture 44, or heated oxidant stream travels through optional oxidant introduction line 42*a* directly into reaction zone 50 such that heavy oil/water mixture 32 and heated oxidant stream enter reaction zone 50 as separate streams. In one embodiment, the reaction mixture can have about 200:1 to 5:1 weight ratio of oxygen to petroleum. In another embodiment, the reaction mixture can have about 20:1 to 2:1 weight ratio of oxygen to petroleum. Preferably, the portion of the transporting line having reaction mixture 44 is well insulated to avoid temperature drop prior to entering reaction zone 50. Additionally, in embodiments wherein the oxygen-containing species is a peroxide compound, oxidant introduction line is long enough for peroxide compounds to decompose for generating oxygen in the heated oxidant stream.

The pressure and temperature within reaction zone 50 are maintained at points at or above the critical pressure of water in order to ensure the water is maintained in its supercritical form, in a preferred embodiment, the temperature within the reaction zone is about 380° C. to about 550° C., more preferably about 390° C. to about 500° C., and most preferably about 400° C. to about 450° C. The combination of the oxidant, heavy oil and supercritical water results in the hydrocarbons undergoing cracking, thereby forming upgraded mixture 52. In embodiments of the present invention, reaction zone 50 is essentially free of an externally-provided catalyst and essentially free of an externally-provided hydrogen source. Reaction zone 50 can include a tubular type reactor, a vessel type reactor equipped with stirrer or others known in the art. Reaction zone 50 can be horizontal, vertical or a combination of the two.

Upgraded mixture 52 is then cooled in cooling zone 60 using any acceptable means of cooling to create creating cooled upgraded-mixture 62. Preferably, cooled upgraded-mixture 62 has a temperature within the range of about 5° C. to about 150° C., more preferably about 10° C. to about 100° C., and most preferably about 25° C. to about 70° C. Cooled upgraded-mixture 62 is then depressurized by pressure regulating zone 70 to create pressure reduced upgraded-mixture 72. Preferably, pressure reduced upgraded-mixture 72 has a pressure of about 0.1 MPa to about 0.5 MPa, more preferably 0.1 MPa to about 0.2 MPa.

In another embodiment, pressure regulating zone 70 comprises at least two pressure regulating valves, and more preferably three pressure regulating valves 70*a*, 70*b*, 70*c* connected in a parallel fashion. This arrangement advantageously provides for continued operation in the event a primary regulating valve becomes plugged. Pressure reduced upgraded-mixture 72 then enters liquid-gas separator 80, wherein pressure reduced upgraded-mixture 72 is separated into gas stream 82 and liquid stream 84. Liquid stream 84 is then fed into oil-water separator 90 to yield upgraded oil stream 92 and recovered water stream 94. In an alternate embodiment, recovered water stream 94*a* can be recycled back into the process, which is preferably upstream mixing zone 30. In an additional embodiment not shown, liquid-gas separator 80 and oil-water separator 90 can be combined into one device such as a three phase separator that is operable to separate pressure reduced upgraded-mixture 72 into separate gas, oil, and water phases.

The process of the present invention is further demonstrated by the following illustrative embodiment, which is not limiting of the process of the present invention.

EXAMPLE #1

Simultaneous Mixing of all Three Streams

Whole range Arabian Heavy crude oil (AH), deionized water (DW), and oxidant stream (OS) were pressurized by respective metering pumps to approximately 25 MPa. Volumetric flow rates of AH and DW at standard condition were 3.06 and 6.18 ml/minute, respectively. Oxidant stream had an oxygen concentration of 4.7 weight percent oxygen in water (e.g. 10.05 weight percent hydrogen peroxide with 89.95 weight percent water). Hydrogen peroxide was dissolved in water completely before subjected to pump. Flow rate of oxidant stream was 1.2 ml/minute.

The streams were subjected to individual pre-heaters. AH was preheated to 150° C., DW was preheated to 450° C. and OS was preheated to 450° C. AH, DW and OS were combined using a cross fitting having 0.125 inch internal diameter to form the reactant mixture. The reactant mixture was then fed to the reaction zone. The reaction zone comprised a main hydrothermal reactor which had 200 ml internal volume and was vertically oriented. The upgraded mixture's temperature was adjusted to be 380° C. Upon exiting the reaction zone, the upgraded mixture was cooled to 60° C. by a chiller to produce the cooled upgraded-mixture. Cooled upgraded-mixture was depressurized by back pressure regulator to atmospheric pressure. Product was separated into gas, oil and water phase products. Total liquid yield (oil+water) was around 95 weight percent after operation of the process for 12 hours. Oil phase product was subjected to analysis. Table 1 shows representative properties of whole range Arabian Heavy (AH) and final product (Petroleum product).

EXAMPLE #2

Illustrative Embodiment of the Present Invention

Whole range Arabian Heavy crude oil (AH), deionized water (DW), and oxidant stream (OS) were pressurized by respective metering pumps to approximately 25 MPa. Volumetric flow rates of AH and DW at standard condition were 3.06 and 6.18 ml/minute, respectively. Oxidant stream had an oxygen concentration of 4.7 weight percent oxygen in water (e.g. 10.05 weight percent hydrogen peroxide with 89.95 weight percent water). Hydrogen peroxide was dissolved in water completely before subjected to pump. Flow rate of oxidant stream was 1.2 ml/minute.

The streams were subjected to individual pre-heaters. AH was preheated to 150° C., DW was preheated to 450° C. and OS was preheated to 450° C. AH and DW were combined using a tee fitting having 0.125 inch internal diameter to form combined stream (CS). CS had a temperature of about 377° C., which was above critical temperature of water. OS was integrated with CS by an integrating device to form the reactant mixture. The reactant mixture was then fed to the reaction zone. The reaction zone comprised a main hydrothermal reactor which had 200 ml internal volume and was vertically oriented. The upgraded mixture's temperature was adjusted to be 380° C. Upon exiting the reaction zone, the upgraded mixture was cooled to 60° C. by a chiller to produce the cooled upgraded-mixture. Cooled upgraded-mixture was depressurized by back pressure regulator to atmospheric pressure. Product was separated into gas, oil and water phase products. Total liquid yield (oil+water) was around 100 weight percent after operation of the process for 12 hours. Oil phase product was subjected to analysis. Table 1 shows representative properties of whole range Arabian Heavy (AH) and final product (Petroleum product).

TABLE 1

Properties of Feedstock and Products

| | Total Sulfur | API Gravity | Distillation, T80(° C.) |
|---|---|---|---|
| Whole Range Arabian Heavy | 2.94 wt % sulfur | 21.7 | 716 |
| Example 1 | 1.91 wt % sulfur | 23.5 | 639 |
| Example 2 | 1.59 wt % sulfur | 24.1 | 610 |

Advantageously, the current invention provides improvements such as increased sulfur removal, increased API Gravity and lower distillation temperature. Additionally, the current invention surprisingly produces very little coke. In one embodiment, the present invention is believed to produce only 1 weight % of coke, as compared to much higher levels of coke in the prior art.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed.

I claim:

1. A process for upgrading heavy oil in an environment free of an externally supplied catalyst or externally supplied hydrogen source, the process comprising the steps of:

combining a heated heavy oil stream with a heated water feed in a mixing zone to form a heavy oil/water mixture and allowing the heavy oil/water mixture to become well mixed, wherein the heavy oil/water mixture is at a temperature and pressure that exceeds the critical temperature and pressure of water;

adding a heated oxidant stream to the heavy oil/water mixture to form a reaction mixture, wherein the heated oxidant stream is at a temperature and pressure that exceeds the critical temperature and pressure of water;

introducing the reaction mixture into a reaction zone, wherein the reaction mixture is subjected to operating conditions that are at or exceed the supercritical conditions of water, such that at least a portion of hydrocarbons in the reaction mixture undergo cracking to form an upgraded mixture, the reaction zone being essentially free of an externally-provided catalyst;

removing the upgraded mixture from the reaction zone and cooling and depressurizing the upgraded mixture to form a cooled upgraded-mixture;

separating the cooled upgraded-mixture into a gas stream and a liquid stream; and separating the liquid stream into upgraded oil and recovered water, wherein the upgraded oil has reduced amounts of asphaltene, sulfur, nitrogen or metal containing substances and an increased API gravity as compared to the heated heavy oil stream.

2. The process of claim 1, wherein the reaction zone is essentially free of an externally-provided hydrogen source.

3. The process of claim 1, wherein the mixing zone comprises an ultrasonic wave generator, the ultrasonic wave generator operable to emit a frequency.

4. The process of claim 3, further comprising subjecting the heavy oil/water mixture to ultrasonic waves prior to adding the heated oxidant stream.

5. The process of claim 3, wherein the frequency is in a range from about 10 to about 50 kHz.

6. The process of claim 3, wherein the range of the frequency of the ultrasonic waves produced from the ultrasonic wave generator is about 20 to about 40 kHz.

7. The process of claim 1, wherein the heavy oil/water mixture has a residence time within the mixing zone in the range of about 10 to about 120 minutes.

8. The process of claim 1, wherein the heated heavy oil stream has an oil temperature, wherein the oil temperature is in the range of about 10 degrees Celsius to about 250 degrees Celsius, and the heated heavy oil stream is at a pressure at or exceeding the critical pressure of water.

9. The process of claim 1, wherein the heated water stream has a water temperature, wherein the water temperature is in the range of about 250 degrees Celsius to about 650 degrees Celsius, and the heated water stream is at a pressure at or exceeding the critical pressure of water.

10. The process of claim 1, wherein the heated oxidant stream has an oxidant temperature, wherein the oxidant temperature is in the range of about 250 degrees Celsius to about 650 degrees Celsius at a pressure, and the oxidant stream is at or exceeding the critical pressure of water.

11. The process of claim 1, wherein the oxidant stream comprises an oxygen-containing species and water.

12. The process of claim 11, wherein the oxygen-containing species is selected from the group consisting of oxygen gas, air, hydrogen peroxide, organic peroxide, inorganic peroxide, inorganic superoxide, sulfuric acid, nitric acid, and combinations thereof.

13. The process of claim 11, wherein the oxidant stream has an oxygen-containing species concentration of about 0.1 weight percent to about 75 weight percent.

14. The process of claim 1, wherein the reactant mixture has a residence time within the reaction zone of 1 second to 120 minutes.

15. The process of claim 1, wherein the reactant mixture has a residence time within the reaction zone of 1 minute to 60 minutes.

16. A process for upgrading heavy oil in an environment free of an externally supplied catalyst or externally supplied hydrogen source, the process comprising the steps of:

combining a heated heavy oil stream with a heated water feed in a mixing zone to form a heavy oil/water mixture and allowing the heavy oil/water mixture to become well mixed;

introducing the heavy oil/water mixture in the presence of an oxidant stream into a reaction zone, wherein the heavy oil/water mixture and oxidant stream are subjected to operating conditions that are at or exceed the supercritical conditions of water, such that at least a portion of hydrocarbons in the heavy oil/water mixture undergo cracking to form an upgraded mixture, the reaction zone being essentially free of an externally-provided catalyst and essentially free of an externally-provided hydrogen source;

removing the upgraded mixture from the reaction zone;

cooling and depressurizing the upgraded mixture to form a cooled upgraded-mixture;

separating the cooled upgraded-mixture into a gas stream and a liquid stream; and separating the liquid stream into upgraded oil and recovered water, wherein the upgraded oil is an upgraded heavy oil having reduced amounts of asphaltene, sulfur, nitrogen or metal containing substances and an increased API gravity as compared to the heated heavy oil stream.

17. A process for upgrading heavy oil in an environment free of an externally supplied catalyst or externally supplied hydrogen source, the process comprising:

heating a pressurized oxidant stream to a temperature that is between 250° C. and 650° C., wherein the pressurized oxidant stream is at a pressure exceeding the critical pressure of water;

mixing a heated heavy oil stream and a heated water feed stream to form a heated oil/water stream, wherein the heated oil stream is comprised of hydrocarbon molecules, wherein the water stream is comprised of supercritical water fluid, wherein the supercritical water fluid is in an amount sufficient to completely surround substantially all of the individual hydrocarbon molecules thereby producing a cage effect around substantially all of the hydrocarbon molecules;

combining the pressurized oxidant stream with the heavy oil/water stream in a reaction zone under reaction zone conditions, wherein the reaction zone conditions are at or exceed the supercritical temperature and pressure of water, such that a substantial portion of the hydrocarbon molecules are upgraded thereby forming an upgraded mixture;

cooling, depressurizing, and separating the upgraded mixture into a gas phase, an oil phase and a recovered water phase, wherein the oil phase has reduced amounts of asphaltene, sulfur, nitrogen or metal containing substances and an increased API gravity as compared to the heated heavy oil stream, as well as reduced amounts of coke formation as compared to a process having an absence of cage effect around substantially all of the hydrocarbon molecules.

* * * * *